United States Patent [19]

Raines et al.

[11] Patent Number: 4,973,073

[45] Date of Patent: Nov. 27, 1990

[54] SNOWBOARD BINDING

[76] Inventors: Mark A. Raines, 20200 SW. Brightwood Ct., Alona; Gregory A. Deeney, 17450 Fieldstone Dr., Beaverton, both of Oreg. 97006

[21] Appl. No.: 325,460

[22] Filed: Mar. 17, 1989

[51] Int. Cl.[5] ..... A63C 9/02; A63C 9/20

[52] U.S. Cl. ..... 280/624; 280/618; 280/627; 280/633; 280/14.2

[58] Field of Search ..... 280/14.2, 618, 623, 280/624, 627, 634, 635, 636, 607, 613, 633; 441/70

[56] References Cited

U.S. PATENT DOCUMENTS

| | | | |
|---|---|---|---|
| 3,271,040 | 9/1966 | Spademan | 280/624 |
| 3,280,411 | 10/1966 | Brock | 441/70 |
| 3,560,011 | 2/1971 | Spademan | 280/624 |
| 3,797,841 | 3/1974 | McAusland | 280/624 |
| 3,888,497 | 6/1975 | Zahradka | 280/623 X |
| 3,900,204 | 8/1975 | Weber | 280/11.13 |
| 3,945,658 | 3/1976 | Frechin | 280/11.35 |
| 4,061,356 | 12/1977 | Salomon | 280/605 |
| 4,061,357 | 12/1977 | Salomon | 280/605 |
| 4,157,192 | 6/1979 | Hrachowitz et al. | 280/618 |
| 4,160,556 | 7/1979 | Gertsch | 280/618 |
| 4,395,055 | 7/1983 | Spademan | 280/624 |
| 4,415,176 | 11/1983 | Hull et al. | 280/624 X |
| 4,652,007 | 3/1987 | Dennis | 280/618 |
| 4,741,550 | 5/1988 | Dennis | 280/618 |

FOREIGN PATENT DOCUMENTS

| | | | |
|---|---|---|---|
| 1077893 | 11/1954 | France | 280/635 |
| 2592807 | 7/1987 | France | 280/618 |
| 2600548 | 12/1987 | France | 280/618 |
| 322456 | 11/1934 | Italy | 280/635 |

*Primary Examiner*—David M. Mitchell
*Assistant Examiner*—Brian L. Johnson
*Attorney, Agent, or Firm*—Klarquist, Sparkman, Campbell, Leigh & Whinston

[57] ABSTRACT

A step-in binding for snowboards secures a rider's foot such that it can only be manually released. Ridge-entrapping members on the snowboard define opposed pockets. The pockets receive oppositely extending longitudinal ridges that are a part of a boot or harness apparatus which attaches to the rider's foot. A spring-loaded latch, operable by a camming mechanism as a rider is stepping in, engages and secures one of the ridges.

24 Claims, 4 Drawing Sheets

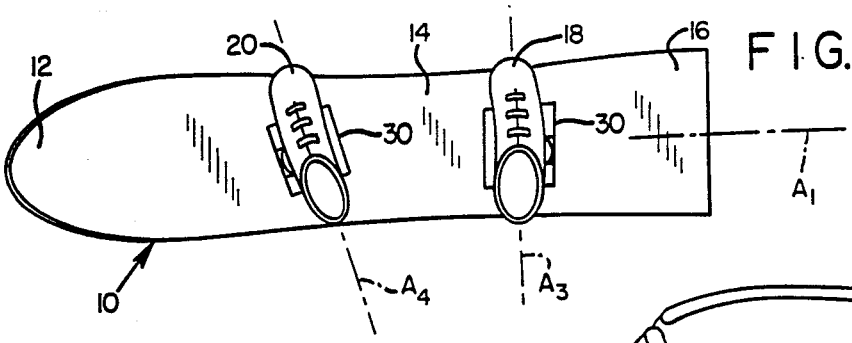
FIG. 1
FIG. 2
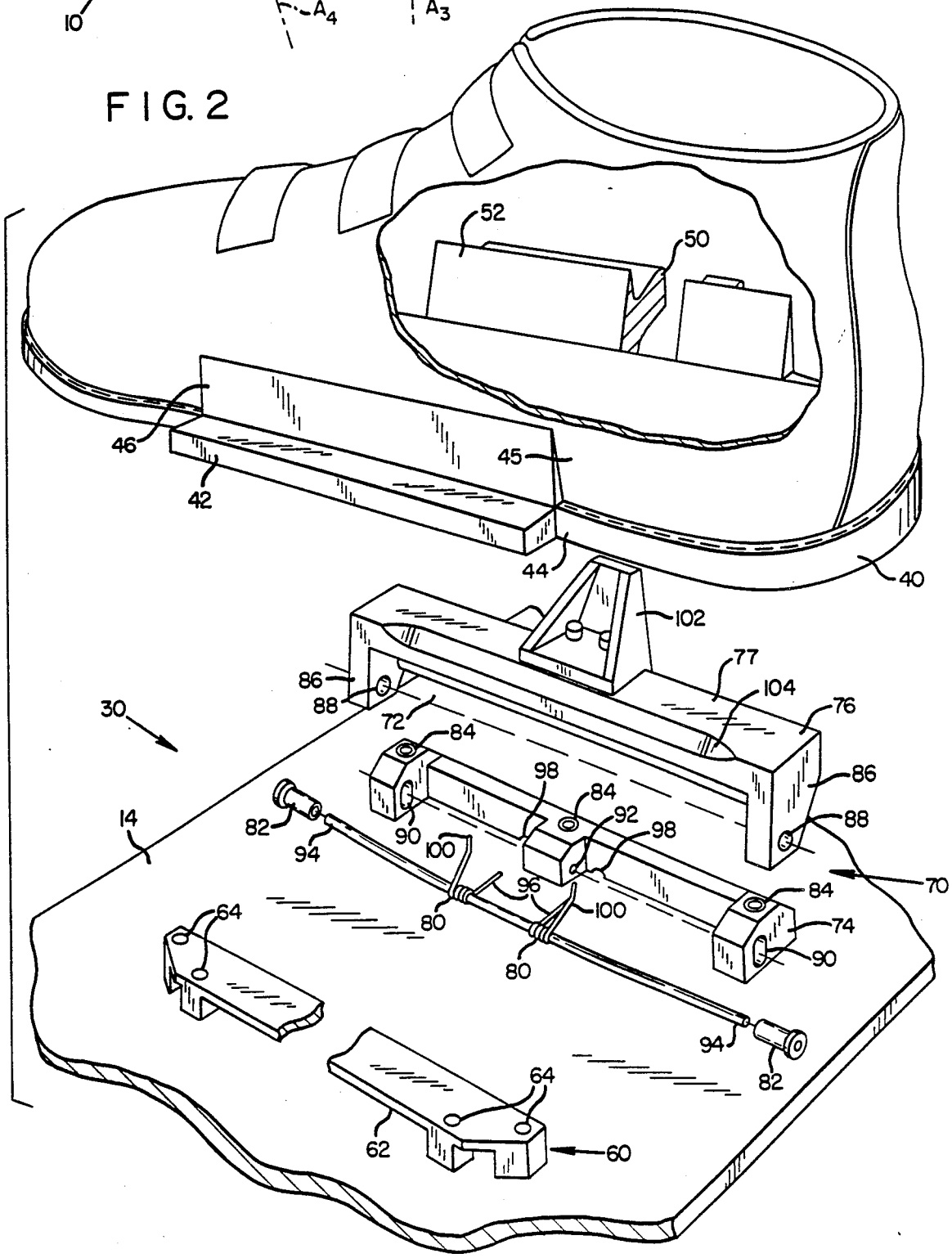

SNOWBOARD BINDING

FIELD OF THE INVENTION

This invention relates to an apparatus for binding a rider's foot to the riding surface of a snowboard.

BACKGROUND OF THE INVENTION

Snowboarding is a winter sport with similarities to both skiing and surfing. During a descent down a snow-covered slope, the rider stands on a "snowboard" which is shorter and wider than a ski but with a turned up front end similar to a ski. Instead of having feet pointing forward as on skis, a rider stands on the riding surface of the snowboard with the rear foot oriented approximately normally to the longitudinal axis of the snowboard and the forward foot oriented at some angle relative to the longitudinal axis of the snowboard. In other words, a rider's stance on a snowboard is similar to a surfer's or skateboarder's stance, not a skier's. In contrast to surfing, at least one of the rider's feet should be bound to the snowboard. In many cases, the rider's booted feet are strapped onto the riding surface. However, such straps are cumbersome to fasten or unfasten when the rider is mounting or dismounting the snowboard, respectively.

"Step-in" bindings are well-known with conventional snow skis. Such bindings enable the skier to rapidly bind his booted feet to his skis, as well as release the ski boots from the skis at the end of the ski run. Further, conventional ski bindings are designed to release the ski from the skier's boot during a fall and whenever the ski is twisted relative to the skier's leg in a potentially injurious manner, thereby preventing serious injury to the skier.

The principal reasons why conventional snow skis are equipped with safety-release bindings are that (a) each of the skier's booted feet is attached to a separate ski, both of which can go in separate directions and/or become entangled when the skier falls, greatly increasing the chance of leg fractures and torn ligaments; and (b) skis are usually long and can apply enormous levered forces to a skier's legs and leg joints during a fall, which can cause serious injury.

In contrast with conventional snow skis, snowboards are short. Further, the snowboarder rides on only one device, rather than two as in conventional snow skiing. As a result, during a fall, the snowboarder's legs and feet are held closely together, because both are still attached to the snowboard, thereby greatly diminishing the probability of serious injury. Consequently, the form of safety-release binding commonly found on snow skis is regarded by many as inappropriate for use on a snowboard. In fact, unplanned release of a snowboarder's foot from the snowboard could cause more injury during a fall than if the rider's feet had remained attached to the snowboard. Since a snowboarder's feet are oriented relative to the longitudinal axis of the snowboard entirely differently than a skier's feet on conventional snow skis, use of conventional ski bindings to secure a snowboarder's feet to a snowboard will not necessarily protect the rider from injury.

Dennis (U.S. Pat. Nos. 4,652,007 and 4,741,550) discloses a releasable binding system for snowboarding that employs conventional snow ski bindings mounted along the longitudinal axis of the snowboard. The rider wears boots fitted with special boot plates possessing transverse foot-shaped wing that can be bound into the ski bindings while keeping the rider's feet oriented transversely to the longitudinal axis of the snowboard. The two bindings are mechanically interconnected on the snowboard such that release of one foot from a binding will cause release of the second foot. Disadvantages of this binding system include: (a) the bindings release when the rider falls, which can cause more injury to the rider than if the snowboard remained attached to the rider; (b) the forces that would cause conventional ski bindings oriented parallel to the longitudinal axis of the snowboard to release are inappropriate for the release of a snowboarder's feet which are oriented transversely to the direction of travel of the snowboard; (c) such a binding system actually requires two separate bindings for each foot, one to bind the boot to the boot plate, the other to bind the boot plate to the snowboard; (d) if the snowboarder releases one foot, the other foot cannot remain attached to the snowboard, which can be very inconvenient and possibly unsafe when a snowboarder must dismount from a ski lift in preparation for a downhill run. Further, many snowboarders prefer to leave one foot always bound to the snowboard (generally the forward foot) while leaving the other foot free until just before beginning a downhill run. Leaving one foot free better enables the snowboarder to maneuver into a starting position or otherwise get around without having to detach the snowboard. Existing strap-in bindings, however, are inconvenient for such purposes because of the time and difficulty involved in strapping in the free foot just before beginning a downhill run.

Hence, there is a need for a simple binding mechanism for a snowboard that will enable the rider to quickly detach the bound foot when required while leaving the other foot bound to the snowboard, and permitting the rider to quickly reattach the free foot to the snowboard just before beginning a downhill run. Further, there is a need for such an apparatus that will keep the rider's feet bound to the snowboard even during a fall. Further, there is a need for such a binding mechanism that will not release both feet upon the releasing of only one foot from the snowboard. Further, there is a need for a snowboard binding that will enable the rider to "step into" the binding while remaining standing.

SUMMARY OF THE INVENTION

The present invention is an apparatus for binding a rider's foot to the riding surface of a snowboard in a customary riding position and orientation. The apparatus of the present invention can be used to independently bind either one or both of the rider's feet to the snowboard. On each foot to be bound, the rider wears a soled boot having opposing horizontally projecting ridges that extend generally parallel to each other along the lateral edges of the boot sole. The ridges on a mounted boot are gripped by a pair of opposing mating sockets on the riding surface of the snowboard. One of the sockets has a spring-biased hooking lip that can be urged aside by the corresponding ridge on the rider's boot, thereby enabling the rider to "step into" the binding. After the ridge is fully seated in the socket, the hooking lip returns to a latched position, thereby binding the boot to the snowboard.

To release the boot, the rider manually actuates a lever attached to the spring-biased hooking lip, thereby releasing the corresponding boot ridge from the socket, and allowing the rider to lift his boot out of the binding. If the rider binds only one foot according to the present invention, the other foot may be strapped onto the snowboard via a conventional snowboard binding. If both feet are bound to the snowboard according to the present invention, release of one foot will not actuate release of the other foot. Further, the binding is not designed to release the rider's foot during a fall. Finally, according to the present invention, the rider's booted feet are gripped along the lateral edges of the boot sole rather than the toe and heel, the lateral edges receiving a greater amount of mechanical stress than the toe and heel when a snowboarder makes a descent.

Therefore, a primary object of the present invention is to provide a new and improved apparatus for binding at least one of a rider's booted feet to the riding surface of a snowboard in a proper orientation and position for snowboarding.

Another object is to bind the rider's feet such that the rider's feet will remain attached to a snowboard even during a fall.

A further object is to provide for manual release of one foot from a snowboard without the consequential release of the other foot.

A further object is to provide a binding for snowboards that does not utilize conventional ski safety bindings which are not designed for snowboard use.

A further object of the present invention is to bind the rider's feet to a snowboard along the lateral edges of the boot, such portions of the boot receiving a greater mechanical stress during a snowboard descent of a snow-covered slope than the toe and heel of the boot.

A further object is to provide a step-in binding for snowboarding that will enable the rider to quickly attach a snowboard without having to bend over or engage an assistant.

A further object is to allow the rider to keep one foot bound to a snowboard while the other foot is released therefrom, facilitating mounting and dismounting a ski lift and performing other maneuvers in preparation for or after a descent.

Finally, an object of the present invention is to provide a boot for snowboarding that can be bound to a snowboard along the lateral edges of the boot, not on the toe and heel, and to provide a latching means therefor on the snowboard.

BRIEF DESCRIPTION OF THE DRAWINGS

A complete understanding of the invention may be obtained from the following detailed description thereof, when read in conjunction with the accompanying drawings, in which:

FIG. 1 is a plan view of a snowboard showing both the rider's boots bound to the riding surface thereof according to the present invention;

FIG. 2 is an isometric exploded view of one type of snowboarding boot and binding according to the present invention, a portion of the boot being broken away to show hidden detail;

DETAILED DESCRIPTION

Figure 3:
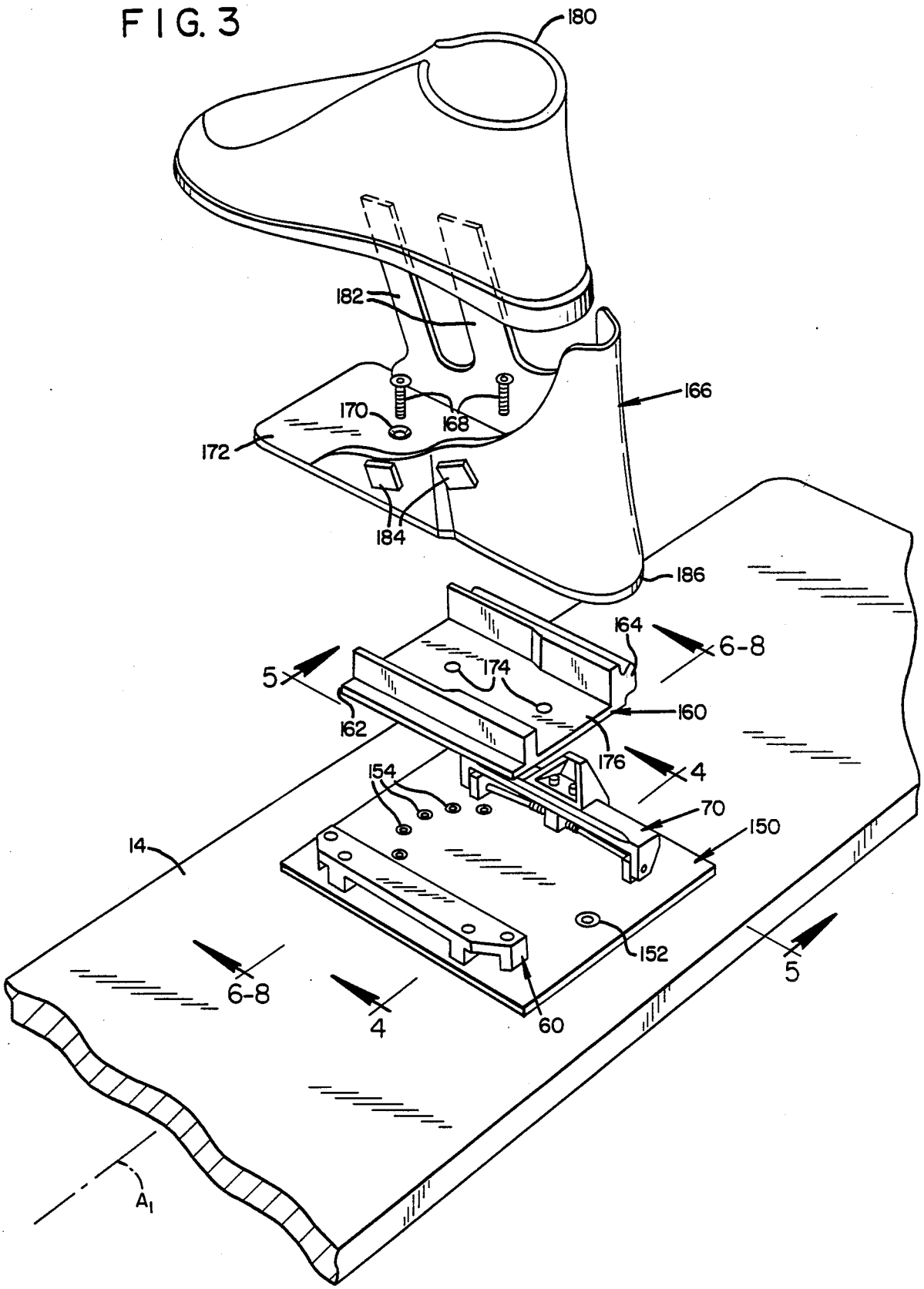
FIG. 3 is an isometric exploded view of a second type of snowboarding binding according to the present invention.

The present invention provides a new and improved apparatus for binding one or both of a rider's feet to the riding surface of a snowboard. Referring to FIG. 1, a snowboard 10 is a longitudinally extended structure that is similar to both a snow ski and a surfboard. It has an upward turned front end 12, a riding surface 14 and a tail portion 16. A snowboard is shorter and wider than a snow ski, and is typically constructed of a laminate of plastic, wood and/or metal. In contrast with a snow ski, where the rider's feet are bound to the ski pointing substantially toward the front end of the ski, a snowboard is ridden by the rider in a standing position with his feet oriented at or near right angles to the longitudinal axis of the snowboard. Typically, the longitudinal axis $A_3$ of the rider's trailing foot, shown in FIG. 1 as the rider's right foot 18, is usually oriented substantially at right angles to the longitudinal axis $A_1$ of the snowboard 10. The longitudinal axis $A_4$ of the rider's forward foot, shown in FIG. 1 as the left foot 20, is usually oriented at some angle relative to the longitudinal axis $A_1$ of the snowboard 10, with the toe usually pointed slightly forward. The exact positions and orientations of the rider's feet may vary somewhat, depending upon the snowboard design, the rider's personal preference as to stance, and anticipated slope conditions.

In contrast to the sport of surfing, where the rider merely stands with unbound bare feet on the riding surface of the surfboard, one or both of a snowboarder's booted feet must be bound to the riding surface of the snowboard. FIG. 1 shows both feet bound to the snowboard 10 using a binding apparatus 30 according to the present invention as described in detail below. As can be seen in FIG. 1, a snowboarder typically wears some form of boot to protect his feet and the provide support. Although FIG. 1 shows both the rider's forward foot 20 and trailing foot 18 bound to the riding surface 14 of the snowboard 10 using a binding apparatus 30 according to the present invention, the "step-in" feature of the present invention, as described in further detail below, is particularly advantageous for the trailing foot 18. Hence, the rider may wish to bind his forward foot 20 using a conventional buckle-on snowboard binding system. However, the "step-in" binding means of the present invention can be used for binding both the rider's feet to the riding surface of the snowboard, as shown in FIG. 1.

Referring now to FIG. 2, the riding surface 14 of a snowboard is equipped with at least one binding means 30 according to the present invention A rider's boot 18 (the right boot is shown) is illustrated to show an example of a modified boot sole harness 40 according to the present invention which enables the boot to be bound to the riding surface 14 with the binding 30. The modified boot sole 40 has a first longitudinally extended binding ridge 42 projecting horizontally outward from the lateral instep edge 44 of the sole 40. Although it is preferable that the first binding ridge 42 extend from the instep edge 44 of the sole 40, it may also extend from the opposite lateral edge of the sole 40 and still be within the scope of the present invention. The first binding ridge 42 can be molded as an integral part of the sole 40. For increased support at required, an upwardly projecting flap 46 may also be molded into the sole 40 along the base of the first ridge 42 and cemented, sewn, riveted, or otherwise attached to the boot upper 45. The edge of the boot sole 40 opposite the first binding ridge 42 is equipped with a second longitudinally extended binding ridge 50 projecting outward in a direction opposite that of the first binding ridge 42. The second binding ridge 50 is substantially parallel to the first binding ridge 42. Although the second binding ridge is shown in FIG. 2 as having a different shape than the first binding ridge 42, it is of course possible for the first binding ridge 42 to be shaped identically to the second binding ridge 50 and still be within the scope of the present invention. (A portion of the boot 18 has been cut away in FIG. 2 to show the second binding ridge 50 on the opposite edge of the sole 40 from the first binding ridge 42.) Similar to the first binding ridge 42, the second binding ridge 50 can also be a molded extension of the sole 40, projecting horizontally outward from the sole edge and from a side flap 52 affixed to the boot upper 45 in a manner similar to side flap 46.

On the riding surface 14 of the snowboard is a first ridge-entrapping member 60 defining a fixed horizontally opening longitudinally extended socket 62 shaped to interlockingly receive the first binding ridge 42. The first ridge-entrapping member 60 can be bolted to the surface of the snowboard using screws 64 or bonded to the surface with an appropriate adhesive. Alternatively, the first ridge-entrapping member 60 may be fabricated as an integral part of the riding surface 14 of the snowboard, obviating the need for the screws 64. The longitudinal socket 62 is essentially the open space defined by the first ridge-entrapping member 60 and the underlying riding surface of the snowboard 14. In FIG. 2, the first ridge-entrapping member 60 is shown mounted at right angles to the longitudinal axis of the snowboard, but other orientations are possible according to the preference of the rider.

A second ridge-entrapping member 70 defining a second longitudinally extended socket 72 is also mounted to the riding surface of the snowboard 14 opposite the first socket 62 a distance approximately equal to or slightly greater than the distance between the bases of the parallel binding ridges 42 and 50. In the example shown in FIG. 2 where the binding ridges 42 and 50 are integral with the boot sole 40, the distance is approximately equal to or slightly greater than the width of the boot sole 40 at the first and second binding ridges 42 and 50, respectively.

The second ridge-entrapping member 70 is comprised of a base portion 74, a hooking lip 76 which is rotatably mounted to the base portion 74, an axle 78, biasing springs 80, bushings 82 and a handle 102. The base portion 74 can be affixed to the riding surface 14 of the snowboard via screws 84 or bonded to the surface with an appropriate adhesive. Alternatively, the base portion 74 may be fabricated as an integral part of the riding surface 14 of the snowboard, obviating the need for the screws 84. The hooking lip 76 has opposing downward projecting portions 86 on the ends thereof, longitudinally spaced slightly further apart from each other than the length of the base portion 74. The hooking lip 76 is rotatably mounted via the downward projecting portions 86 to the base portion 74 via the axle 78, which extends through the holes 88 in the downward projecting portions 86, through holes 90 in the base portion 74 and through hole 92 in the middle of the base portion 74. The axle 78 also threads through the coiled portion of springs 80. The axle 78 is held in place via two end bushings 82, each of which extends into the corresponding vertically extended hole 90 in the base portion 74 and either press fitted or otherwise secured onto the corresponding end 94 of the axle 78. One end 96 of each spring 80 is inserted into a slot 98 in the lower surface of the base portion 74. The remaining end 100 of each spring 80 extends diagonally upward and rests on the rear surface 77 of the hooking lip 76.

The springs 80 serve to bias the rotational motion of the hooking lip 76 about an axis $A_1$ defined by the axle 78. In other words, the hooking lip 76 is urged to remain in a latched position. To move the hooking lip 76 from the latched position to an open position, thereby permitting the binding ridge 50 to be seated in the longitudinal socket 72, the handle 102 is manually moved in a direction away from the first ridge-entrapping member 60.

Referring further to FIG. 2, in order for the rider to bind his boot 18 to the riding surface 14 of the snowboard, he must first insert the first binding ridge 42 into the longitudinal socket 62 defined by the first ridge-entrapping member 60. After the first binding ridge 42 is fully seated in the socket 62, the rider merely needs to continue lowering the boot sole 40 toward the riding surface 14, thereby pressing the second binding ridge 50 against the leading edge surface 104 of the hooking lip 76. Such engagement of the second binding ridge 50 against the hooking lip 76 urges the hooking lip 76 to rotate about the axis defined by axle 78 into an open position (described in further detail below). Hooking lip 76 moving to the open position enables the second binding ridge 50 to slip downward past the hooking lip 76 and become fully seated in the second socket 72, at which time the hooking lip 76 returns to the latched position. Now, the boot 18 is bound to the riding surface 14 of the snowboard. Because the above sequence can be performed by the rider while standing, the binding apparatus of the present invention is a "step-in" type which is convenient and simple to operate.

In order to release a bound boot 18 from the riding surface 14 of the snowboard, the rider must manually push the handle 102 away from the boot 18, thereby rotating the hooking lip 76 about the axle 78 from the latched position to an open position. Once the hooking lip 76 is in an open position, the second binding ridge 50 may be lifted out of the second socket 72, which then allows the first binding ridge 42 to be lifted out of the first socket 62.

The binding apparatus of the present invention is strictly a "manual-release" type. If the rider should fall while on the snowboard, his bound feet will not release therefrom, unless by some unusual circumstance the handle 102 is pushed during the fall to the open position sufficiently to allow the boot to release. Further, each binding apparatus of the present invention is independent. Release of one foot from a binding will not cause the release of the other foot.

Referring now to FIG. 3, it can be seen that, instead of affixing the first ridge-entrapping member 60 and second ridge-entrapping member 70 directly to the surface of the snowboard 14 as described above, both ridge-entrapping members may be bolted or otherwise secured to a mounting plate 150 which is then attached to the riding surface 14 of the snowboard. The mounting plate 150 defines a pivot hole 152 and a selected number of mounting holes 154 spaced along a bolt circle arc on the mounting plate 150 at a certain radius from the pivot hole 152. The holes 152 and 154 enable the rider to attach the mounting plate 150 to the riding surface 14 of the snowboard in any of a selected number of angular orientations relative to the longitudinal axis of the snowboard FIG. 3 also shows that, instead of the first and second ridges being integral with the boot sole as shown in FIG. 2, the first ridge 162 and second ridge 164 may extend outward from opposing lateral edges of a separate binding plate 160. The binding plate 160 can be either attached directly to the sole of the rider's boot (direct attachment to boot not shown) or to the sole 172 of a boot harness 166 via a suitable means such as short screws 168 fastened through countersunk holes 170 defined by the sole 172 of the boot harness 166 and into the corresponding holes 174 defined by the base 176 of the binding plate 160. Other means of securing the binding plate 160 to either the sole of the rider's boot or the sole of the boot harness, such as an appropriate adhesive, are also possible. It is also possible for the binding plate 160 to be not a separate entity but molded into the sole 186 of the boot harness 166 analogous to the boot shown in FIG. 2. The boot harness 166 may be any of several types that are commercially available for snowboarding and used for strapping the rider's shoe or boor 180 (or even the rider's bare foot, if desired) to the snowboard riding surface 14. Typically, the boot harness 166 has two or more buckled straps 182, each of which wraps around a front portion of the boot 180 and engages a corresponding hook 184 or analogous fastening means on the opposing side of the boot harness 166.

Figure 4:
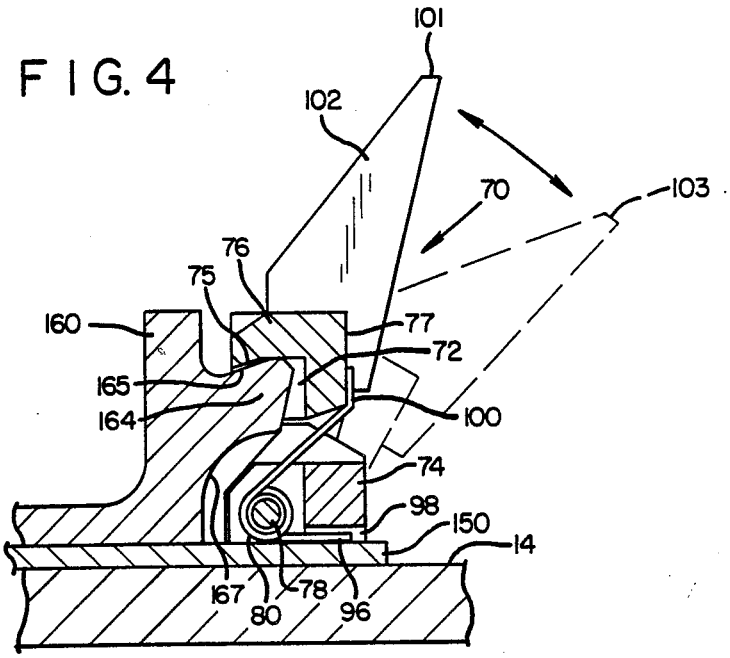
FIG. 4 is a sectional view of a portion of the binding of FIG. 3 taken along line 4—4 of FIG. 3.

FIGS. 4–8 provide further details of the binding apparatus according to the present invention and its operation, the version detailed being that shown in FIG. 3 utilizing a binding plate 160. FIG. 4 is a sectional view along a line parallel to the longitudinal axis $A_1$ of the snowboard (see FIG. 3) of the second ridge 164 and the second ridge-entrapping member 70 shown in the latched position. As can be seen, the second ridge 164 extends from the binding plate 160. The hooking lip 76 is rotatable about the axle 78 from a fully latched position 101 to an open position 103, such rotation from the fully latched position 101 resisted by torsion springs 80 and flexing of the axle 78 (described below). As described above, the springs 80 are held in place during assembly by insertion of the first spring end 96 into the slot 98 on the underside of the base portion 74 and by positioning the second end 100 of the spring 80 against the rear surface 77 of the hooking lip 76. The rider, in order to release his boot, must manually press the handle 102 from the fully latched position 101 to the open position 103 (FIG. 4).

In FIG. 4, the upper surface 165 of the binding ridge 164 is oriented non-horizontally, giving the binding ridge 164 a distinctly upward-pointing cross-sectional profile, as shown in FIG. 4. The lower surface 75 of the hooking lip 76 is oriented approximately complementary to the upper surface 165 of the binding ridge 164. Such engagement of the complementary surfaces helps to keep the hooking lip 76 in a latched position 101 over the second binding ridge 64.

Figure 5:
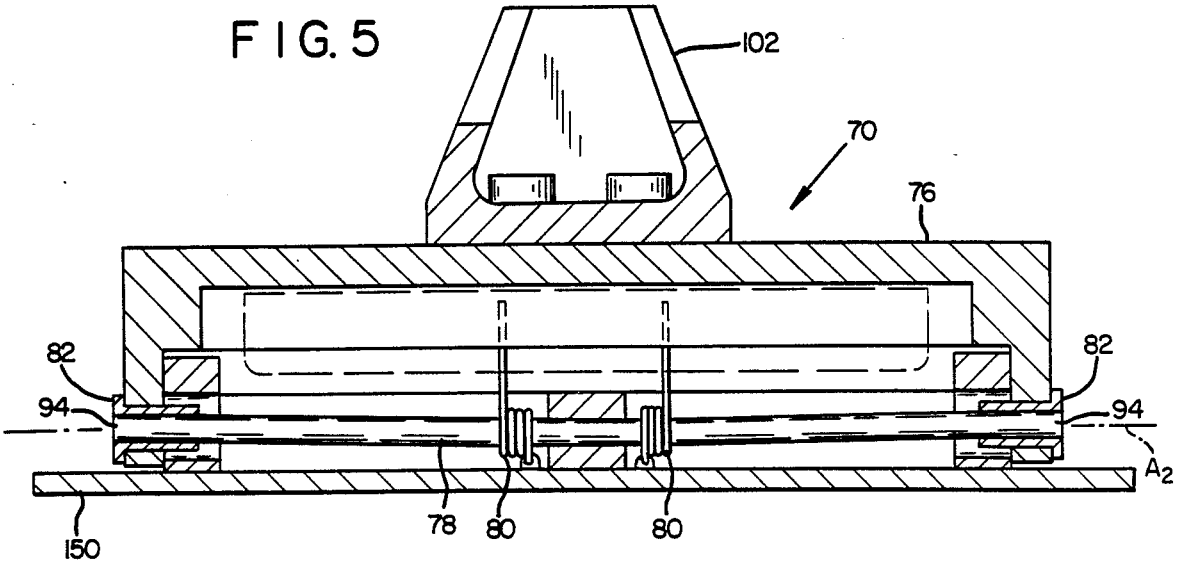
FIG. 5 is a transverse sectional view taken along line 5—5 of FIG. 3.

FIG. 5 is a sectional view through the length of the second ridge-entrapping member 70 and hooking lip 76 through the axis of axle 78. As can be seen, even when the hooking lip 76 is in the latched position, the ends 94 of the axle 78 are flexed slightly upwardly, imparting a downward bias to the hooking lip 76. That downward spring bias further tends to keep the hooking lip 76 in the latched position.

Figure 6:
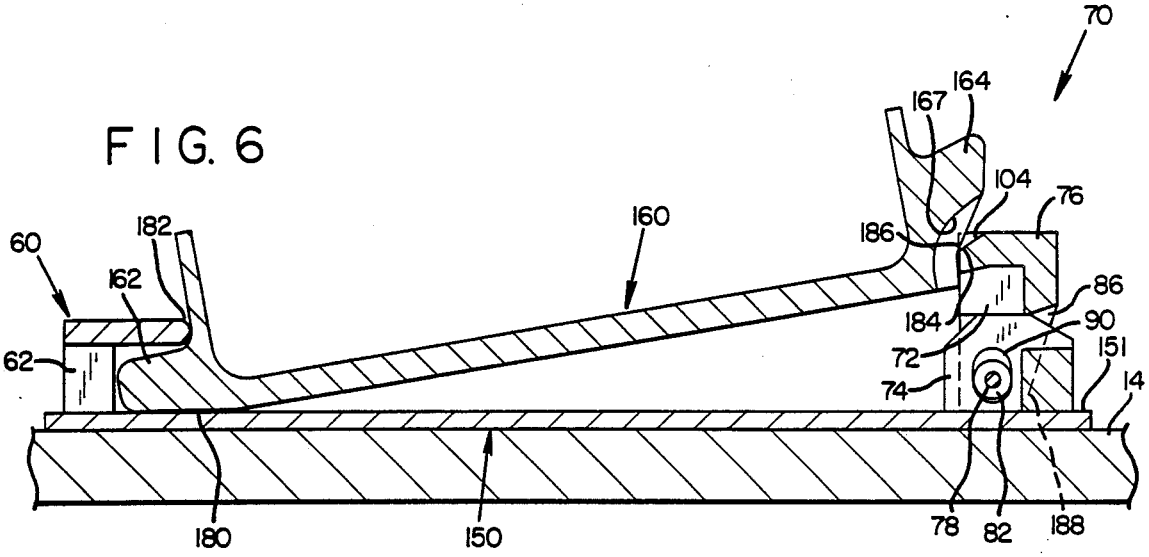
FIG. 6 is a sectional view taken along line 6–8—6–8 of FIG. 3, before latching the second boot ridge along a line parallel to the longitudinal axis of the snowboard.
Figure 7:
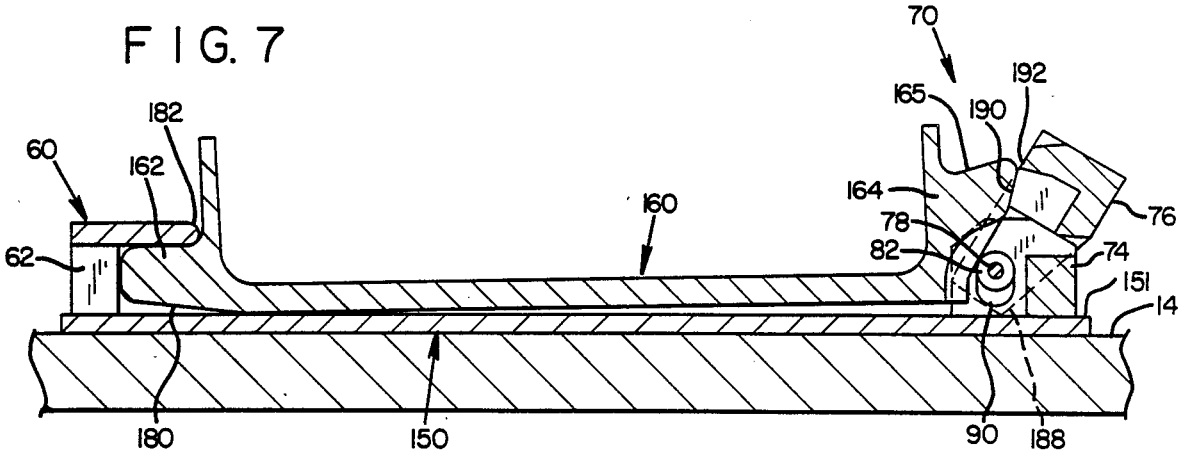
FIG. 7 is a sectional view taken along line 6–8—6–8 of FIG. 3, just before completing the latching of the second boot ridge along a line parallel to the longitudinal axis of the snowboard.
Figure 8:
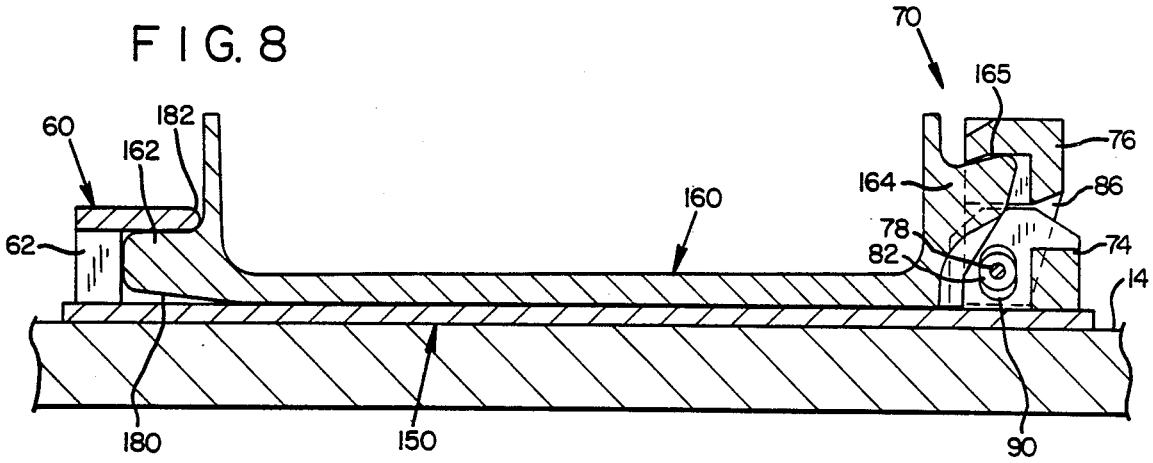
FIG. 8 is a sectional view taken along line 6–8—6–8 of FIG. 3, at the completion of binding along a line parallel to the longitudinal axis of the snowboard.

Referring now to FIGS. 6–8, wherein the rider's boot is represented by a binding plate 160 (such as that illustrated in FIG. 3), the latching sequence by which the rider's boot becomes fully bound to the snowboard is shown. Although FIGS. 6–8 depict the use of a binding plate, the sequence shown is also applicable when the first and second binding ridges are integral with the sole of the rider's boot or boot harness. Further, FIGS. 6–8 depict the use of a mounting plate 150 used to mount the first and second ridge-entrapping members to the riding surface 14 of the snowboard. However, as described above, the first and second ridge-entrapping members may also be mounted directly to the riding surface 14 of the snowboard, obviating the need for a mounting plate. Obviously, the sequences shown in FIGS. 6–8 are also applicable in the latter situation.

Beginning with FIG. 6, the rider first inserts the first binding ridge 162 into the first socket 62 defined by the first ridge-entrapping member 60. If necessary, the first binding ridge 162 may have a slight chamfer 180 on the lower surface thereof to aid insertion of the first binding ridge 162 into the first socket 62. The edge of the first ridge-entrapping member 60 pointing toward the second ridge-entrapping member 70 may have a protrusion 182 to aid in keeping the binding plate 160 (or boot or boot harness) centered in the binding after binding is completed.

Once the first binding ridge 162 has been inserted into the first socket 62, the second binding ridge 164 is lowered against the leading edge 184 of the hooking lip 76. As the second binding ridge 164 is urged downward against the hooking lip 76, a cam surface 186 on each and of the second binding ridge 164 begins to push against the leading edge 184 of the hooking lip 76, thereby urging the hooking lip 76 from the latched position (shown in FIG. 6) to the open position (shown in FIG. 7). The hooking lip 76 may have a longitudinally extended chamfer 104 on the upper surface thereof to aid the cam action. As shown in FIGS. 6 and 7, as the hooking lip 76 rotates to the open position, the rear corner 188 on each downward projecting portion 86 of the hooking lip 76 presses against the upper surface 151 of the mounting plate 150 (or against the riding surface 14 of the snowboard if no mounting plate is used). When this happens, the hooking lip, as it rotates to the open position, also moves slightly upward, the upward motion resisted by the tendency of the axle 78 to remain linear. Vertically elongated holes 90 extending through each end of the base portion 74 permit such limited upward movement of the hooking lip 76 as it moves toward the open position. This upward movement of the hooking lip 76 eases the process of inserting the second binding ridge into the second socket 72. The downward bias provided by the flexing axle 78 also keeps the rider's boot tightly bound to the snowboard after binding is completed.

FIG. 7 shows the hooking lip 76 in the full open position which was reached by the sequential action of cam surfaces 186 on each end of the second binding ridge 164 pressing against the leading edge 184 on the hooking lip 76 and of cam surface 190 on the second binding ridge 164 pressing against the underside edge 192 on the hooking lip 76.

Further lowering of the second binding ridge 164 toward the riding surface 14 of the snowboard will cause the underside edge 192 of the hooking lip 76 to ride over onto the top surface 165 of the second binding ridge 164, thereby allowing the hooking lip 76 to return to the latched position, as shown in FIG. 8. In the fully latched position shown in FIG. 8, the hooking lip 76 has moved slightly downwardly, as indicated by the lower vertical position of the bushing 82 in the vertically extended hole 90 in FIG. 8 compared to in FIG. 7.

FIGS. 4 and 6–8 also show that the underside surface 167 of the second binding ridge 164 between the ends thereof is somewhat hollowed out to provide clearance for the springs 80 and the base portion 74 when the second binding ridge 164 is fully inserted into the socket 72.

Having illustrated and described the principles of our invention with reference to several preferred embodiments, it should be apparent to those of ordinary skill in the art that such embodiments may be modified in detail without departing from such principles. We claim as our invention all such modifications as come within the true spirit and scope of the following claims.

We claim:

1. An apparatus for binding a snowboard rider's foot to a snowboard having a riding surface and a longitudinal snowboard axis, the rider's foot having a longitudinal foot axis, the apparatus comprising:

a boot worn by a rider on the rider's foot to be bound to the snowboard, the boot including a substantially planar sole portion having a first lateral sole edge and an opposing second lateral sole edge, wherein the first lateral sole edge has a longitudinally extending first binding ridge projecting outwardly from said first lateral sole edge and substantially parallel to the sole portion, and the second lateral sole edge has a longitudinally extending second binding ridge substantially parallel to the first binding ridge and projecting outwardly from said second lateral sole edge and substantially parallel to the sole portion; and a binding mounted on the riding surface of the snowboard for attaching the boot to the riding surface such that the boot remains attached to the riding surface until the rider manually releases the boot from the binding, the binding interlockingly engaging the first and second binding ridges, the binding including a first ridge-entrapping member defining a fixed first socket extending substantially transversely to the snowboard axis having an opening dimensioned to allow the first binding ridge to be inserted in a direction substantially parallel to the riding surface into the first socket so as to interlockingly engage the first binding ridge when attaching the boot to the riding surface, and a second ridge-entrapping member defining a second socket extending substantially transversely to the snowboard axis substantially parallel to the first socket, the first and second sockets lying in a plane substantially parallel to the riding surface, and the second socket spaced laterally apart from the first socket so as to permit the second binding ridge to be interlocking engaged in the second socket after the first binding ridge has been interlockingly engaged in the first socket, the second ridge-entrapping member including a base portion, an axle substantially parallel to the first socket mounted tot he base portion, a hooking lip pivotally mounted to the base portion via the axle such that the hooking lip is pivotable in a direction away from the firs ridge-entrapping member from a latched position to an open position allowing insertion of the second binding ridge into and removal of the second binding ridge from the second socket in a substantially vertical direction whenever the first binding ridge is interlockingly engaged in the first socket, and biasing means operably engaged with the hooking lip and base portion, the biasing means urging the hooking lip to return to the latched position.

2. An apparatus for binding a snowboard rider's foot to a snowboard as recited in claim 1 wherein the first binding ridge includes a chamfered lower to facilitate insertion of the first binding ridge in a direction substantially parallel to the riding surface into the first socket.

3. An apparatus for binding a snowboard rider's foot to a snowboard as recited in claim 1 wherein the hooking lip of the second ridge-entrapping member includes a leading upper edge and the second binding ridge includes a lower surface having at least one cam surface which, when the first binding ridge is interlockingly engaged in the first socket and the second binding ridge is urged in a direction substantially perpendicular to the riding surface into contact with the hooking lip for the purpose of interlockingly engaging the second binding ridge in the second socket, engages the leading upper edge of the hooking lip and urges the hooking lip to pivot from the latched position to the open position sufficiently to allow the second binding ridge to be inserted into the second socket, the hooking lip returning to the latched position when the second binding ridge becomes fully inserted in the second socket.

4. An apparatus for binding a snowboard rider's foot to a snowboard as recited in claim 1 wherein the axle includes an axle mid-portion affixed to the base portion and a pair of axle ends each extending in an a opposite direction from said axle mid-portion.

5. An apparatus for binding a snowboard rider's foot to a snowboard as recited in claim 4 wherein the hooking lip includes a first projecting end and a second projecting end each extending substantially toward the base portion and pivotally mounted to the corresponding axle end, each projecting end including a corner portion that, when the hooking lip is pivoted from the latched position to the open position, causes the axle ends to be flexed upward relative to the axle mid-portion, thereby imparting a tension to the axle ends that together with said biasing means urge the hooking lip to remain in the latched position.

6. An apparatus for binding a snowboard rider's foot to a snowboard as recited in claim 1 wherein the second binding ridge further includes an upwardly pointing cross-sectional profile and the hooking lip includes a lower surface shaped complementarily to the upwardly pointing profile of the second binding ridge, the upwardly pointing profile and the complementary surface when interlocking engaged serving to keep the hooking lip in the latched position whenever the rider's boot is bound to the snowboard.

7. An apparatus for binding a snowboard rider's foot to a snowboard as recited in claim 1 further comprising a handle mounted to the hooking lip by which handle the rider manually pivots the hooking lip from the latched position to the open position.

8. An apparatus for binding a snowboard rider's foot to a snowboard as recited in claim 1 wherein the binding further includes a base plate to which are mounted the first and second ridge-entrapping members for mounting the first and second ridge-entrapping members to the riding surface of the snowboard, the base plate mounted to the riding surface such that the longitudinal foot axis relative tot he longitudinal axis of the snowboard is adjustable within a range of greater than zero degrees to ninety degrees within a plane substantially parallel to the riding surface.

9. An apparatus for binding a snowboard rider's booted foot to a snowboard having a riding surface and a longitudinal snowboard axis, the rider's booted foot having a longitudinal foot axis, the apparatus comprising:

a boot harness including means for securing the harness to the boot and a substantially planar sole portion having a first lateral sole edge and an opposing second lateral sole edge, wherein the first lateral sole edge has a longitudinally extending first binding ridge projecting outwardly from said first lateral sole edge and substantially parallel to the sole portion, and the second lateral sole edge has a longitudinally extending second binding ridge substantially parallel to the first binding ridge and projecting outwardly from said second lateral sole edge and substantially parallel to the sole portion; and a binding mounted on the riding surface of the snowboard for attached the boot harness to the riding surface such that the boot harness remains attached to the riding surface until the rider manually releases the boot harness from the binding, the binding interlockingly engaging the first and second binding ridges, the binding including a first ridge-entrapping member defining a fixed first socket extending substantially transversely to the snowboard axis having an opening dimensioned to allow the first binding ridge to be inserted, in a direction substantially parallel to the riding surface into the first socket so as to interlockingly engage the first binding ridge when attaching the boot harness to the riding surface, and a second ridge-entrapping member defining a second socket extending substantially transversely to the snowboard axis substantially parallel to the first socket, the first and second sockets lying in a plane substantially parallel to the riding surface, and the second socket spaced laterally apart from the first socket so as to permit the second binding ridge to be interlockingly engaged in the second socket after the first binding ridge has been interlockingly engaged in the first socket, the second ridge-entrapping member including a base portion, an axle substantially parallel to the first socket mounted to the base portion, a hooking lip pivotally mounted to the base portion via the axle such that the hooking lip is pivotable in a direction away from the first ridge-entrapping member from a latched position to an open position allowing insertion of the second binding ridge into and removal of the second binding ridge from the second socket in a substantially vertical direction whenever the first binding ridge is interlocking engaged in the first socket, and biasing means operably engaged with the hooking lip and base portion, the biasing means urging the hooking lip to return to the latched position.

10. An apparatus for binding a snowboard rider's booted foot to a snowboard as recited in claim 9 wherein the hooking lip of the second ridge-entrapping member includes a leading upper edge and the second binding ridge includes a lower surface having at least one cam surface which, when the first binding ridge is interlockingly engaged in the first socket and the second binding ridge is urged in a direction substantially perpendicular to the riding surface into contact with the hooking lip for the purpose of interlockingly engaging the second binding ridge in the second socket, engages the leading upper edge of the hooking lip and urges the hooking lip to pivot from the latched position to the open position sufficiently to allow the second binding ridge to be inserted into the second socket, the hooking lip returning to the latched position when the second binding ridge is fully inserted in the second socket.

11. An apparatus for binding a snowboard rider's booted foot to a snowboard as recited in claim 9 wherein the axle includes an axle mid-portion affixed to the base portion and a pair of axle ends each extending in an opposite direction from said axle mid-portion.

12. An apparatus for binding a snowboard rider's booted foot to a snowboard as recited in claim 11 wherein the hooking lip includes a first projecting end and a second projecting end each extending substantially toward the base portion and pivotally mounted to the corresponding axle end, each projecting end including a corner portion that, when the hooking lip is pivoted from the latched position to the open position, causes the axle ends to be flexed upward relative to the axle mid-portion, thereby imparting a tension to the axle ends that together with said biasing means urge the hooking lip to return to the latched position when the hooking lip is not held in the open position.

13. An apparatus for binding a snowboard rider's booted foot to a snowboard as recited in claim 9 wherein the second binding ridge further includes an upwardly pointing cross-sectional profile and the hooking lip includes a lower surface shaped complementarily to the upward pointing profile of the complementary surface when interlockingly engaged serving to keep the hooking lip in the latched position whenever the boot harness is bound to the snowboard.

14. An apparatus for binding a snowboard rider's booted foot to a snowboard as recited in claim 9 wherein the binding further includes a handle mounted to the hooking lip by which handle the rider manually pivots the hooking lip from the latched position to the open position.

15. An apparatus for binding a snowboard rider's booted foot to a snowboard as recited in claim 9 wherein the binding further includes abase plate to which are mounted the first and second ridge-entrapping members for mounting the first and second ridge-entrapping members to the riding surface of the snowboard, the base plate mounted to the riding surface such that the longitudinal foot axis relative to the longitudinal axis of the snowboard is adjustable within a range of greater than zero degrees to ninety degrees within a plane substantially parallel to the riding surface.

16. A snowboarding apparatus comprising:

a snowboard having a front portion, a rear portion, a riding surface, and a longitudinal snowboard axis;

foot mounting means adapted to be worn by a snowboard rider on a foot of the rider to be bound to the riding surface said foot mounting means including a substantially planar sole portion having a first lateral sole edge, an opposing second lateral sole edge, and a longitudinal foot axis, wherein the first lateral sole edge has a longitudinally extending first binding ridge projecting outwardly from said first lateral sole edge and substantially parallel to the sole portion, and the second lateral sole edge has a longitudinally extending second binding ridge substantially parallel to the first binding ridge and projecting outwardly from said second lateral sole edge and substantially parallel to the sole portion; and a binding mounted on the riding surface of the snowboard for attaching said foot mounting means to the riding surface such that said foot mounting means remains attached to the riding surface until the rider manually releases the foot mounting means from the binding, the binding interlockingly engaging the first and second binding ridges, the binding including a first ridge-entrapping member defining a fixed first socket extending substancially transversely to the snowboard axis having an opening dimensioned to allow the first binding ridge to be inserted in a direction substantially parallel to the riding surface into the first socket so as to interlockingly engage the first binding ridge when attaching said foot mounting means to the riding surface, and a second ridge-entrapping member defining a second socket extending substantially transversely to the snowboard axis substantially parallel to the first socket, the first and second sockets lying in a plane substantially parallel to the riding surface, and the second socket spaced laterally apart from the first socket so as to permit the second binding ridge to be interlockingly engaged in the second socket after the first binding ridge has been interlockingly engaged in the first socket, the second ridge-entrapping member including a base portion, an axle substantially parallel to the first socket mounted to the base portion, a hooking lip pivotally mounted to the base portion via the axle such that the hooking lip is pivotable in a direction away from the first ridge-entrapping member from a latched position to an open position allowing insertion of the second binding ridge into and removal of the second binding ridge from the second socket in a substantially vertical direction whenever the first binding ridge is interlockingly engaged in the first socket, and biasing means operably engaged with the hooking lip and base portion, the biasing means urging the hooking lip to return to the latched position.

17. A snowboarding apparatus as recited in claim 16 wherein said foot mounting means is a boot worn by the rider on the rider's foot to be bound to the riding surface of the snowboard.

18. A snowboarding apparatus as recited in claim 16 wherein said foot mounting mean sis a boot harness for holding a boot worn by the rider on the rider's foot to be bound to the riding surface of the snowboard.

19. A snowboarding apparatus as recited in claim 16 including a first foot mounting means for mounting a right foot of the rider to the riding surface and a second foot mounting means for mounting a left foot of the rider to the riding surface, said first foot mounting means having a corresponding first binding on the riding surface of the snowboard and said second foot mounting means having a corresponding second binding mounted on the riding surface of the snowboard so as to allow both the right foot and the left foot of the rider to be bound to the riding surface of the snowboard.

20. A snowboarding apparatus as recited in claim 19 wherein the first and second bindings independently bind said first and second foot mounting means, respectively, allowing said first foot mounting means to be removed from the first binding without removing said second foot mounting means from the second binding, and allowing said second foot mounting means to be removed from the second binding without removing said first foot mounting means from the first binding.

21. A snowboarding apparatus as recited in claim 16 wherein the hooking lip of the second ridge-entrapping member includes a leading upper edge and the second binding ridge includes a lower surface having at least one cam surface which, when the first binding ridge is interlockingly engaged in the first socket and the second binding ridge is urged in a vertical direction substantially perpendicular to the riding surface into contact with the hooking lip for the purpose of interlocking engaging the second binding ridge in the second socket, engages the leading upper edge of the hooking lip and urges the hooking lip to pivot from the latched position to the open position sufficiently to allow the second binding ridge to be inserted into the second socket, the hooking lip returning to the latched position when the second binding ridge is fully inserted in the second socket.

22. A snowboarding apparatus as recited in claim 16 wherein the axle includes an axle mid-portion affixed to the base portion and a pair of axle ends each extending in an opposite direction from said axle mid-portion.

23. A snowboarding apparatus as recited in claim 22, wherein the hooking lip includes a first projecting end and a second projecting end each extending substantially toward the base portion and pivotally mounted to a corresponding axle end, each projecting end including a corner portion that, when the hooking lip is pivoted from the latched position to the open position, causes the axle ends to be flexed upward relative to the axle mid-portion, thereby imparting a tension to the axle ends that together with said biasing means urge the hooking lip to return to the latched position when the hooking lip is not held in the open position.

24. A snowboarding apparatus as recited in claim 16 wherein the binding further includes a base plate to which are mounted the first and second ridge-entrapping members for mounting the first and second ridge-entrapping members to the riding surface of the snowboard, the base plate mounted to the riding surface such that the longitudinal foot axis relative to the longitudinal axis of the snowboard is adjustable within a range of greater than zero degrees to ninety degrees within a plane substantially parallel to the riding surface.

* * * * *

UNITED STATES PATENT AND TRADEMARK OFFICE

CERTIFICATE OF CORRECTION

PATENT NO. : 4,973,073

DATED : November 27, 1990

INVENTOR(S) : Mark A. Raines and Gregory A. Deeney

It is certified that error appears in the above-identified patent and that said Letters Patent is hereby corrected as shown below:

Column 5, line 6, "at" should be --as--.
Column 7, line 30, "boor" should be --boot--.
Column 8, line 40, "and" should be --end--.

Column 10, line 1, "tot he" should be --to the--.
Column 10, line 4, "firs" should be --first--.
Column 11, line 8, "tot he" should be --to the--.

UNITED STATES PATENT AND TRADEMARK OFFICE

CERTIFICATE OF CORRECTION

PATENT NO. : 4,973,073

DATED : November 27, 1990

INVENTOR(S) : Mark A. Raines, et. al.

It is certified that error appears in the above-identified patent and that said Letters Patent is hereby corrected as shown below:

Column 11, line 31, "attached" should be --attaching--.
Column 12, line 41, before "complementary" insert --second binding ridge, the upwardly pointing profile and the--.
Column 13, line 57, "mean sis" should be --means is--.

Signed and Sealed this

First Day of September, 1992

*Attest:*

*Attesting Officer*

DOUGLAS B. COMER

*Acting Commissioner of Patents and Trademarks*